US005479752A

United States Patent [19]

Menegoli

[11] Patent Number: 5,479,752

[45] Date of Patent: Jan. 2, 1996

[54] PLANAR ROOFING MADE OF FOLDED METAL SHEETS

[75] Inventor: Fabio Menegoli, San Pietro, Italy

[73] Assignee: ISCOM S.r.l., Pescantina, Italy

[21] Appl. No.: 267,765

[22] Filed: Jul. 5, 1994

[30] Foreign Application Priority Data

Jul. 8, 1993 [IT] Italy ..... VR93U0031
Apr. 14, 1994 [IT] Italy ..... VR94U0025

[51] Int. Cl.[6] ..... E04D 1/34

[52] U.S. Cl. ..... 52/549; 52/545; 52/543

[58] Field of Search ..... 52/543, 545, 546, 52/547, 549, 551, 520, 530, 529, 537, 538, 531, 540

[56] References Cited

U.S. PATENT DOCUMENTS 4,114,247 9/1978 Toti .
5,072,563 12/1991 Menegoli .
5,187,911 2/1993 Cotter ..... 52/549 X

FOREIGN PATENT DOCUMENTS 0306880 3/1989 European Pat. Off. .
2222512 10/1974 France .

*Primary Examiner*—Creighton Smith
*Attorney, Agent, or Firm*—Guido Modiano; Albert Josif

[57] ABSTRACT

A planar roofing made of folded metal sheets which comprises a plurality of metal sheets in which two nonadjacent edges are complementarily folded or otherwise shaped so as to allow the coupling of two adjacent metal sheets by partial overlap, and a plurality of supporting retainer blocks which can be anchored to a purlin for the roofing. Each supporting retainer block comprises a base portion for resting on the purlin and two lateral parallel raised portions that rise from the base and are individually externally flanked by a respective recess which is meant to accommodate a fold which is provided proximate to, and along, a folded edge of a respective metal sheet.

12 Claims, 5 Drawing Sheets

PLANAR ROOFING MADE OF FOLDED METAL SHEETS

BACKGROUND OF THE INVENTION

The present invention relates to a planar roofing made of folded metal sheets.

Various sheet-metal roofing systems have already been proposed which ensure a good roofing for buildings for both civil and industrial use but have some drawbacks mainly connected to difficulties in installation, as complicated maneuvers or the use of special tools are often required.

SUMMARY OF THE INVENTION

The aim of the present invention is to eliminate or substantially reduce the above described drawbacks.

An object of the present invention is to provide a new planar roofing which is constituted by metal sheets having two longitudinal parallel edges which are folded and can be firmly anchored to the purlin of the roof to be covered, without making through holes in the metal sheets, and can withstand even considerable extraction loads due, for example, to negative pressure or suction produced by wind.

Another object of the present invention is to provide a new planar roofing that allows even personnel lacking specific training to easily and rapidly install the plates that form it.

Another object of the present invention is to provide a walkable roofing that is highly durable and can withstand extraction loads caused by the action of wind and can fully drain both rainwater and water produced by the melting of snow or ice.

This and other objects which will become apparent hereinafter are achieved by a planar roofing made of folded metal sheets according to the present invention, which comprises a plurality of metal sheets in which two nonadjacent edges are complementarily folded or otherwise shaped so as to allow the coupling of two adjacent plates by partial overlap, and a plurality of supporting retainer blocks which can be anchored to a purlin for the roofing, and is characterized in that each supporting retainer block comprises a base portion for resting on the purlin and two parallel raised portions that rise from the base and are individually externally flanked by a respective recess which is meant to accommodate a fold or bend which is provided proximate to, and along, a folded edge of a respective metal sheet.

BRIEF DESCRIPTION OF THE DRAWINGS

A few embodiments of the present invention are hereinafter described with reference to the accompanying drawings, wherein.

DESCRIPTION OF THE PREFERRED EMBODIMENTS

Figure 1:
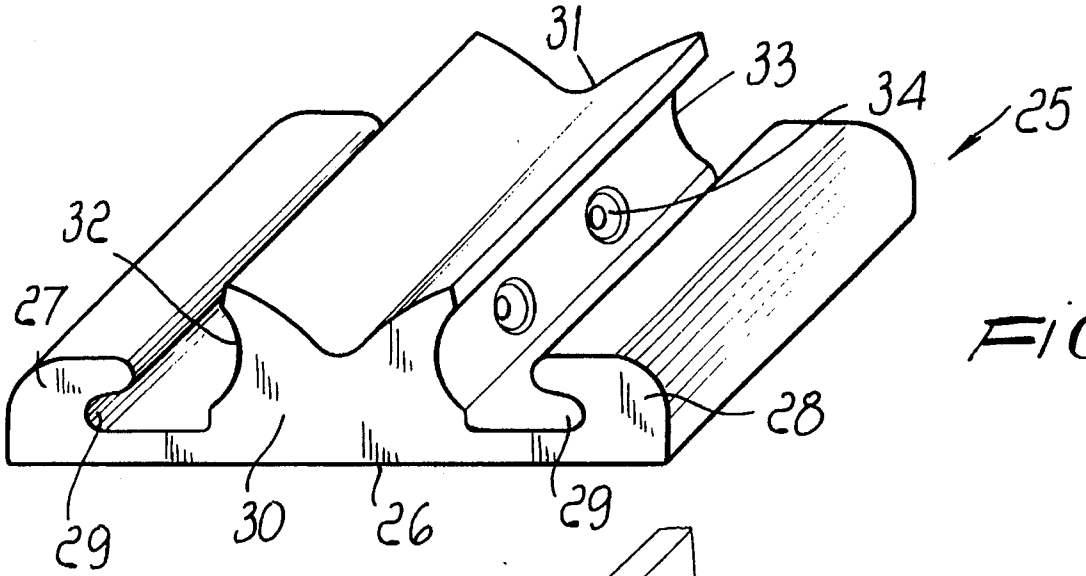
FIG. 1 is a slightly elevated axonometric view of a supporting retainer block.

With reference to FIGS. 1 to 5, it can be seen that a planar roofing according to the present invention is constituted by a sequence of metal sheets or plates 1 wherein two non-adjacent or oppositely arranged edges of each plate are folded, for example by gradual rolling, by pressing or in any other suitable manner, in a complementary manner, so as to allow to perform coupling with an adjacent plate or sheet by overlap and snap-together engagement. More particularly, each plate 1 has an intermediate body or portion 2 which is optionally affected by a plurality of stiffening ridges 3, and has, at both of its folded edges, a rising portion 4 which is constituted by a flat strip and is connected to the body 2 by means of an inclined portion 5. Each rising portion 4 is followed by a depression 6, which is parallel both to the rising portion 4 and to the body 2 and joins the rising portion 4 by means of two consecutive folds 7 and 8, and is followed by a portion 9 that rises at right angles and extends into a further portion 10 which is preferably slightly inclined with respect to said portion 9.

Figure 2:
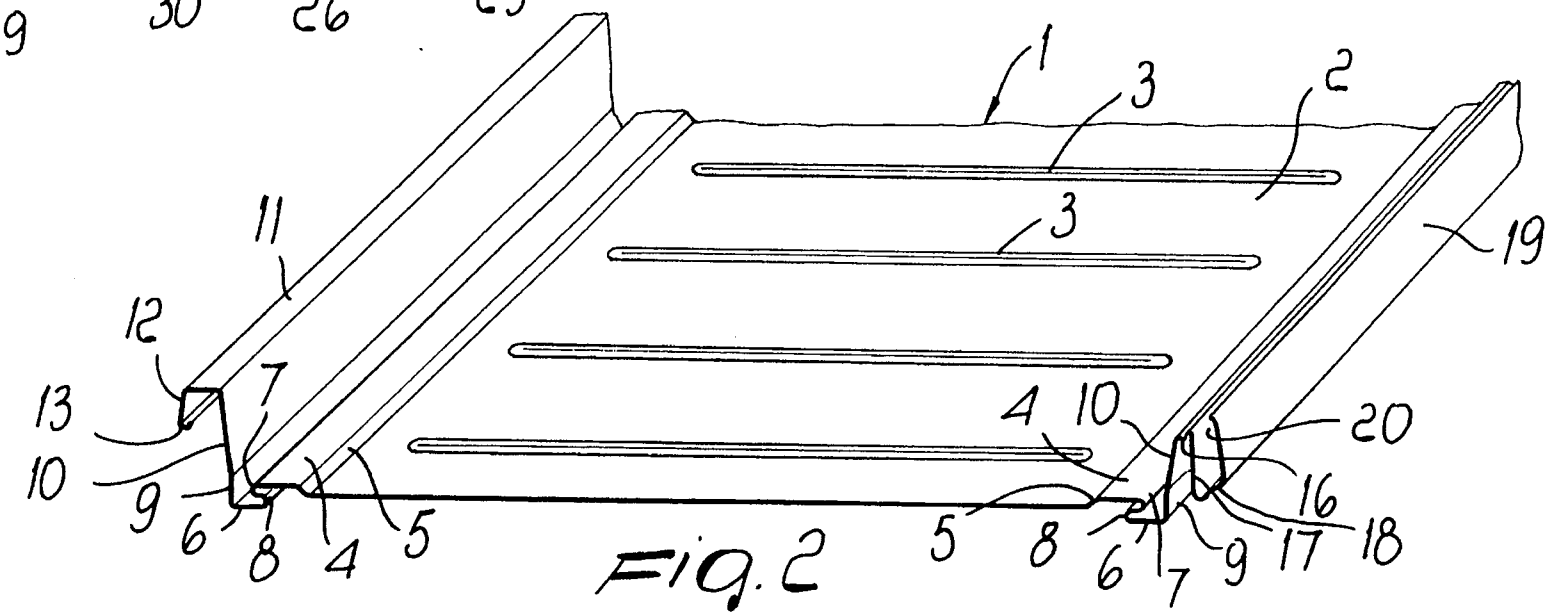
FIG. 2 is an axonometric view of the profile of a metal sheet with lateral folds for forming a roofing with joints provided with an internal drainage channel.
Figure 5:
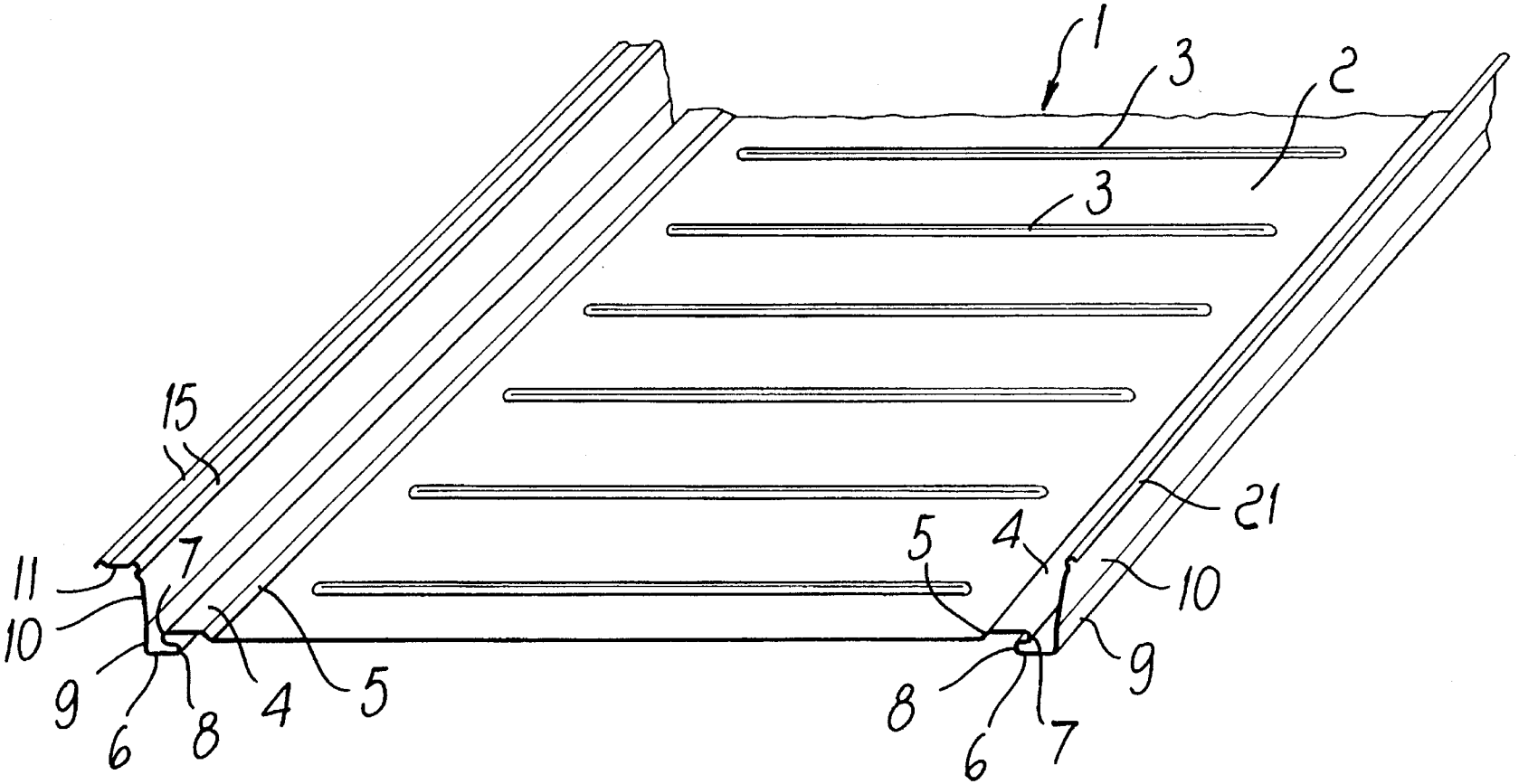
FIG. 5 is an axonometric view of another embodiment of the folded sheet with lateral edges meant to form lap joints without an internal drainage channel.

The portion 10 extends, on one side, into a planar cantilevered portion 11 which, in the embodiment of FIG. 2, continues with a descending end portion 12 which slightly diverges from the portion 11 and ends with a stiffening curl or wing 13, whereas in the embodiment of FIG. 5 said portion 12 is affected by a pair of lateral coupling and stiffening ridges 15.

On the other side, in the embodiment of FIG. 2, the portion 10, at a level equal to the level of the curl 13, is folded outwards in a cantilevered manner and delimits a groove 16 which is open upwards to accommodate and engage the curl 13 of an adjacent plate, then descends considerably along a portion 17, and then rises along an inclined portion 18 and an end portion 19 which is inclined as the portion 10 on the opposite edge, so as to delimit a deep drainage channel 20.

In the embodiment of FIG. 5, the portion 10 ends in the upper region with a ridge 21 for coupling to an outer ridge 15 of an adjacent plate.

The various roofing plates can be anchored to a plurality of supporting retainer blocks 25 which are spaced and aligned along and below the joints between two adjacent metal sheets 1. Each block 25 is constituted by a flat base 26 (FIG. 1) for resting on a purlin (not shown). Two oppositely arranged lateral raised portions 27 and 28 rise from the base 26 and extend in a cantilevered manner above the base along all or part of the length of said base, in order to delimit with said base a respective groove 29 which is suitable to accommodate a fold 8 of a plate 1.

An elevated portion 30 rises at the center of the base 26 and has, at the top, a recess or cradle 31 which is meant to accommodate, and act as support for, an inclined portion 18 of a channel 20, and has on each side a recess 32 and 33 which has a substantially cylindrical wall that runs parallel to the groove 29 that lies in front of it but is arranged at a slightly higher level. The radius of curvature of the wall of the recesses 32 and 33 (see FIG. 3) is such as to allow the snap-together insertion, with partial rotation, of the depression 6 of a plate 1.

At one or both recesses 32 and 33 there are one or more holes 34 for fixing the block by means of screws (not shown in the drawings).

Figure 3:
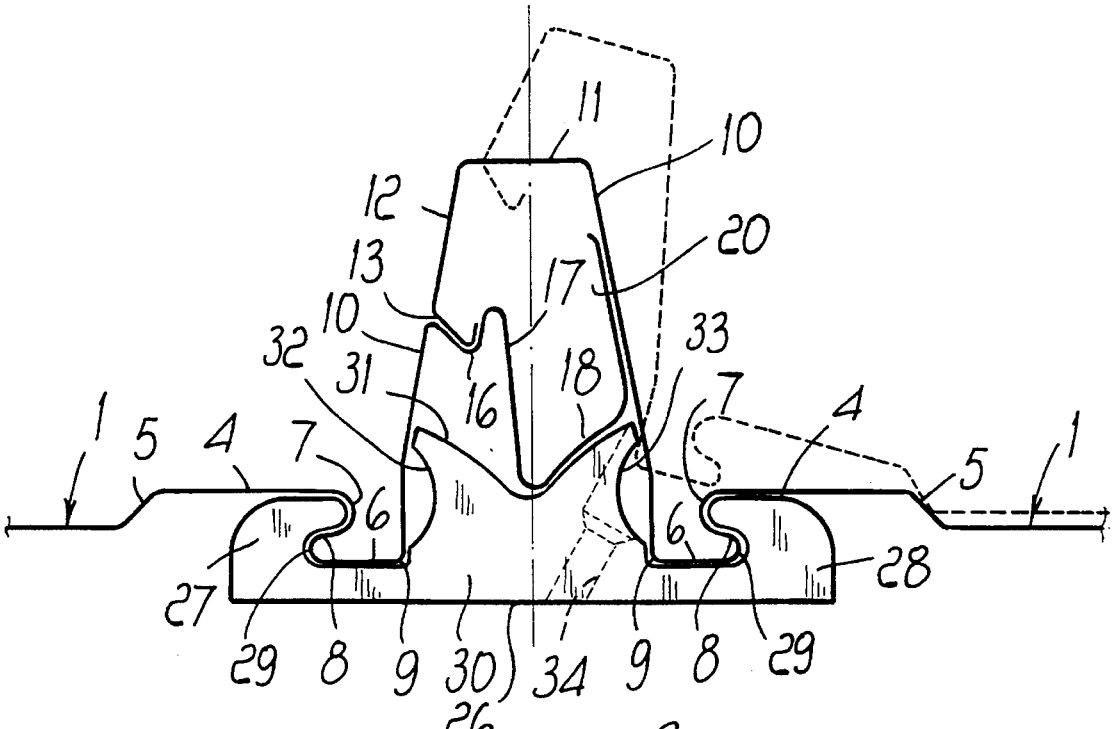
FIGS. 3 and 4 are schematic lateral elevation views of a different step of the installation of two adjacent metal sheets on a supporting retainer block of FIG. 1.

As can be easily understood, in order to install the above described sheets or plates 1 first of all a number of blocks, which is equal to the number of purlins to be covered, is applied, by snap-together coupling, to the edge without a cantilevered portion 11 of a plate, and then the various blocks are fixed to a respective purlin by applying screws or screw anchors in the holes 34. Then a second plate is prepared with its edge provided with a cantilevered portion 11, so that its depression 6 is at the inlet of the free grooves 29 of the already fixed blocks (FIG. 3).

The operator, by pressing with his feet at the rising portion 4 of the second plate, inserts the depression 6 in the groove 29 against the base of the block in a snap-together manner. More specifically, the fold 8 enters the groove 29 first, forcing the portions 9 and 10 to undergo a partial elastic deformation along the recesses 33 so as to allow the final sinking of the depression 6 until it abuts against the base of the blocks and the seating of the adjacent fold 8 within the grooves 29.

While the depression 6 abuts against the base of the block, the cantilevered portion 11 moves so that its wing 13 engages the groove 16 (FIG. 4) or so that its outer ridge 15 engages above the corresponding ridge 21 in the case of plates such as those shown in FIG. 5.

The grooves 29, together with the base and top portions 35 and 36 of the elevated portions 30, ensure optimum resistance to extraction loads or forces which ensures stable anchoring in any atmospheric condition, even in case of very strong wind.

It is evident that the snap-together insertion of the depressions 6 in the grooves 29 with one's feet allows to perform installation in a very short time which can be more than halved with respect to the time required by conventional roofings and without using any equipment.

Advantageously, the blocks 25 are made of an antifriction material, for example reinforced polyamide material, and dielectric, in order to ensure good insulation against stray galvanic currents.

Therefore, in addition to ensuring stable anchoring of the metal sheets to the purlin without making holes in the sheets, said blocks allow the free sliding of the plates, which can thus perform the unavoidable thermal expansion and contraction movements without tensions and resisting stresses that may damage them.

Figure 4:
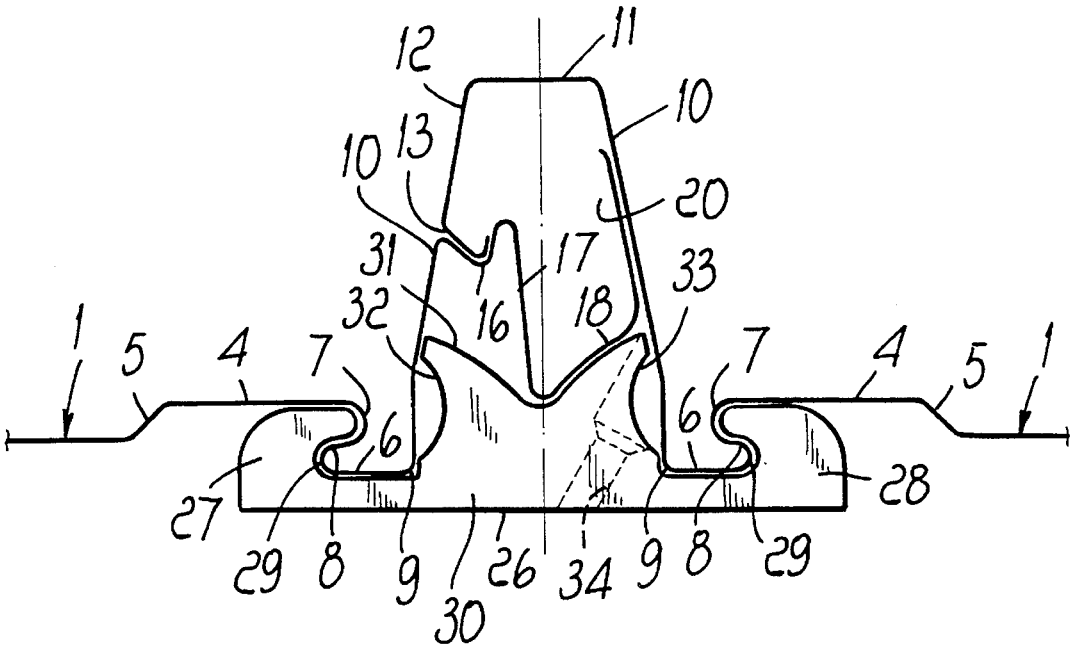

The plates 1 shown in FIGS. 2 to 4 provide a covering with internal drainage channels 20 that ensures absolute watertightness even if the roof is flooded, especially in the case of flat or almost flat roofs.

The plates according to FIG. 5 are particularly suitable for sloping roofs, especially where corrugated plates are traditionally used and where lightweight and economical roofing is required.

Figure 6:
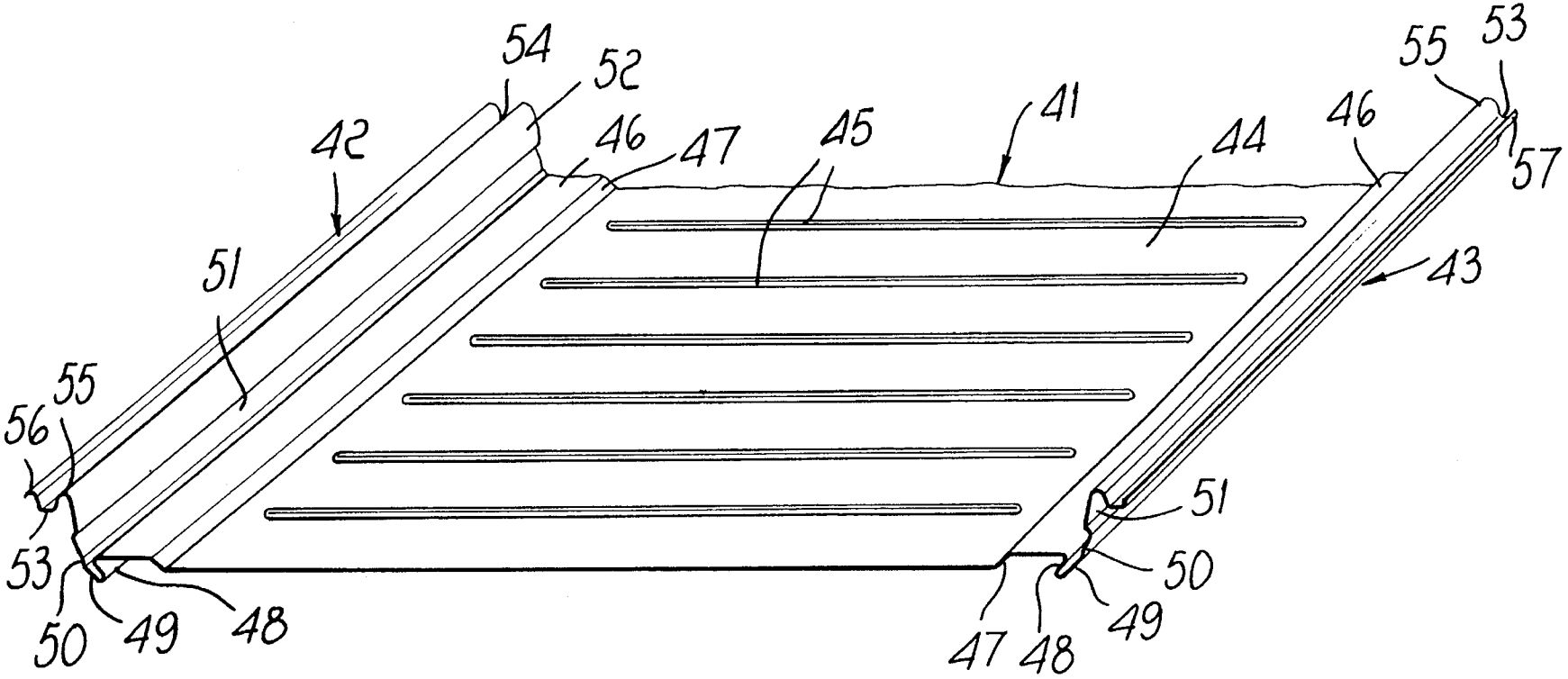
FIG. 6 is a perspective view of another embodiment of a roofing sheet according to the invention.
Figure 7:
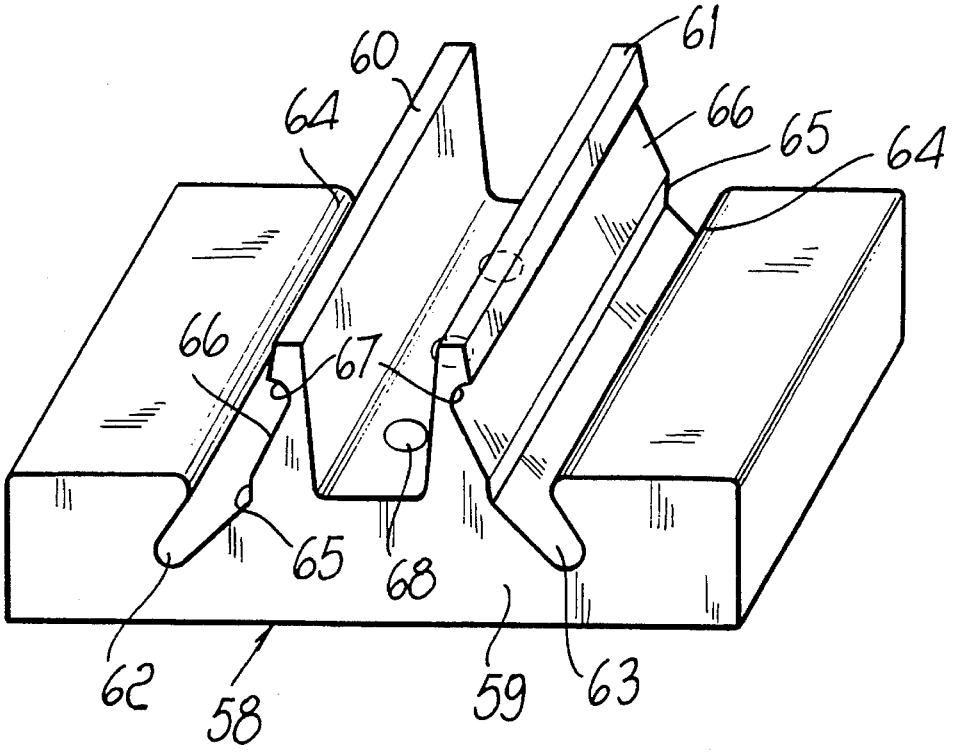
FIG. 7 is a perspective view of a supporting block for use with a roofing sheet of FIG. 6.
Figure 8:
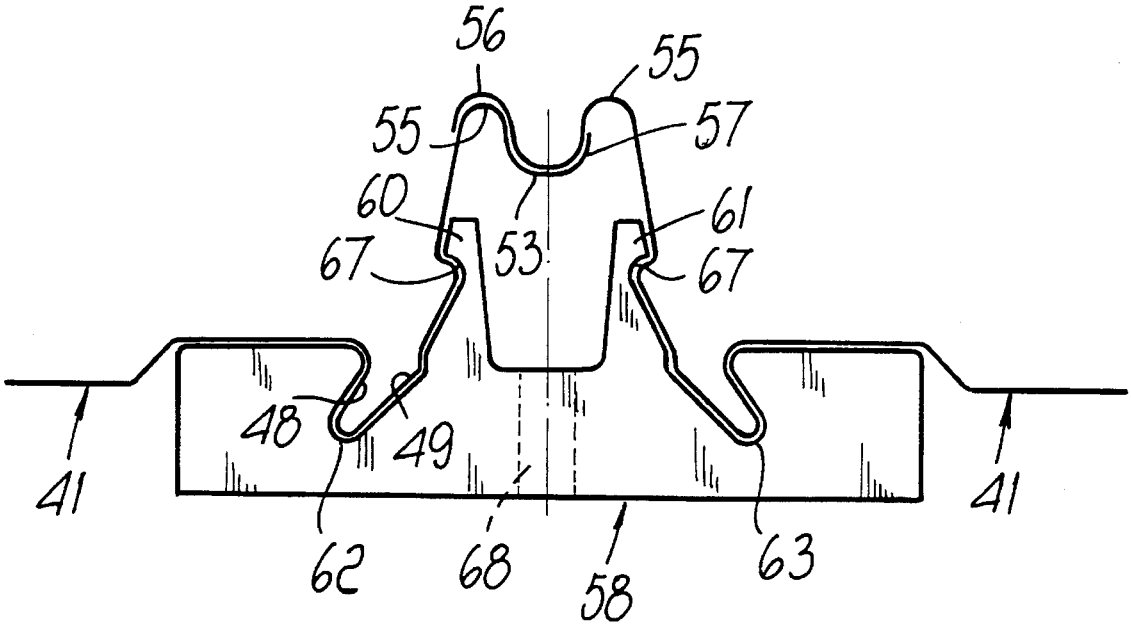
FIG. 8 is a front elevation view of a joint between two adjacent sheets on a supporting block of FIG. 7.

In the embodiment shown in FIGS. 6 to 8, a planar roofing comprises a plurality of metal sheets or plates 1, in each of which two non-adjacent edges 2 and 3 are folded in a complementary manner, for example by rolling, pressing or in any other suitable manner, so as to allow the coupling of two adjacent plates by partial overlap.

More particularly, each plate 41 comprises a flat body or median portion 44 which is optionally affected by transverse reinforcement ridges 45 and is flanked, at each folded edge, by an elevated portion 46 which delimits a flat strip and is connected, on one side to the intermediate portion 44 by means of an inclined portion 47 and on the other side to the adjacent edge 42 or 43 by means of a folded and filleted portion 48. Said portion 48, together with a subsequent folded portion 49, forms a relatively deep recess which is open upward and has a preset inclination with respect to the vertical so that it is directed towards the respective adjacent edge.

The folded portion 49 extends upwards and ends at a head portion 50 which is inclined towards the intermediate portion 44, which in turn continues with a flat portion 51 which is tilted outwards and is folded at the top, with a relatively large radius of curvature, so as to be directed towards the intermediate portion 44. A vertical portion 52 extends from the folded end of the portion 51 and is folded at the top so that it extends outward in a cantilevered manner with an undulated final portion 53 which delimits an upper channel 54. In the case of the edge 52, the channel 54 is flanked by two raised edges 55 and 56, whereas in the case of the edge 43 said channel is delimited by an external wing 57.

The sheets 41 are anchored to a purlin (not shown) with the interposition of a plurality of supporting retainer blocks 58 (FIG. 7). Each block 58 is formed by a base portion 59 which is meant to rest on the purlin, by two parallel and identical raised portions 60 and 61 which rise from the intermediate portion of the block, and by a respective recess or cradle 62 and 63 which lies at the outer side of each raised portion.

The recesses 62 and 63 form a respective groove which is slightly flared and is inclined towards the respective raised portion by a preset angle which is comprised for example between 30° and 60°. At the upper edge of the outer side of each groove 62 and 63 there is a radiused portion 64, whereas at the upper edge of the inner side there is a substantially vertical abutment wall 65 which is followed by a portion of a wall 66 which is inclined towards the respective raised portion 60 or 61, is a part of the outer side of the respective raised portion, and ends with a filleted upper abutment undercut 67.

One or more holes 68, for fixing to the underlying purlin for example by means of screws or screw anchors, are formed in the intermediate region delimited between the raised portions 60 and 61.

In order to install a joint of a roofing according to the present invention it is first of all necessary, as shown in FIG. 8, to fix on the purlins, preferably at modular distances, a plurality of blocks 58 arranged in rows and columns. Then the recess delimited by the portions 48 and 49 of one edge 43 of a sheet 41 is inserted within the groove 52 of a row of aligned blocks, for example by pressing with one's feet, so that its portion 50 abuts against the respective abutment wall 65 of the blocks and so that the portion 41 abuts against the upper undercut 67, whereas the wing 53 and the final undulated portion 57 arranges itself to the side of the raised portions 50 and above them.

Then the edge 42 of another sheet 41 is placed above the undulated end portion 57 of the edge 43 of the already installed sheet, thus mating the folded profile of the edge with the profile of the blocks 57, simply by pressing said edge against the blocks with one's feet. This accordingly forms a sealed lap joint which is extremely stable, as even strong actions of the wind, both as thrust and as suction, are unable to move, much less extract, the recesses of the sheets from the supporting and retention blocks 58; the edges of the sheets remain elastically and permanently locked between the lower grooves 62 and 63 and the upper undercuts 67 of each block.

Advantageously, each block 18, 58 can be made of antifriction material, such as for example reinforced polyamide material, which is also dielectric so as to also ensure good electrical insulation against stray galvanic currents for the building covered by a roofing according to the present invention.

Furthermore, as can be easily noted, the shape of the plates or sheets is such as to allow bending and allows the plates 1, 41 to undergo the effects of thermal expansion and contraction with no problems for the entire roofing, as said plates are retained only by being mated to each other at the overlap region and to the blocks 18, on which they can slide anyway.

The roofing thus has multiple drainage channels, constituted by the recesses delimited by the portions 48 and 49, which allow the discharge of rainwater even in the case of roofs which are not steeply inclined.

The above described invention is susceptible to numerous variations within the protective scope defined by the spirit of the claims that follow.

The materials, as well as the dimensions, may be various according to the requirements.

What is claimed is:

1. A planar roofing made of folded metal sheets, which comprises a plurality of metal sheets in which two non-adjacent edges are complementarily folded so as to allow the coupling of two adjacent sheets by partial overlap, and a plurality of supporting retainer blocks, which can be anchored to a purlin for the roofing, wherein each supporting retainer block comprises a base portion for resting on the purlin, two lateral parallel portions that rise from the external part of the base portion, each lateral parallel portion having a cantilevered part so as to delimit a recess which is meant to accommodate a relatively deep fold or bend which is provided proximate to, and along, a folded edge of a respective metal sheet, each recess being inclined towards the respective raised portion by a preset angle, said supporting retainer blocks comprising furthermore an intermediate elevated portion which has a lateral recess that is directed towards each one of said recesses, runs parallel to them and delimits, in an upper region, a cradle which is meant to act as a support for a drainage channel delimited between two adjacent plates.

2. A roofing according to claim 1, wherein said recess is flared.

3. A roofing according to claim 1, wherein said recess has an outer side with a filleted rim and an inner side which ends with an abutment wall which is inclined with respect to the inner side and is in turn followed by a wall portion that is part of the outer side of said respective parallel raised portions and ends with an upper abutment undercut.

4. A roofing according to claim 1, wherein at least one hole for anchoring means is provided between said parallel raised portions.

5. A roofing according to claim 1, wherein said intermediate elevated portion has at least one hole for accommodating means for fixing to the purlin.

6. A roofing according to claim 1, wherein each sheet has two non-adjacent edges which are folded complementarily so as to allow the coupling of two contiguous plates by partial overlap of the edges above said parallel raised portions of at least one said block and snap-together mating with said recesses of said blocks.

7. A roofing according to claim 6, wherein each of said plates, at each folded edge, has a second raised portion which delimits a flat strip and is connected, by means of a first folded and filleted portion, to a second folded portion so as to delimit a relatively deep recess which is open upward and is meant to fit, in a snap-together manner, in the respective one of said recesses of at least one block.

8. A roofing according to claim 6, wherein said second folded portion ends at an inclined abutment portion which is meant to engage an upper abutment undercut of a plurality of said blocks.

9. A roofing according to claim 1, wherein each said plate has, at two of its said folded edges, a rising portion followed by a depression with the interposition of a double fold which is meant to engage, during use, a respective groove of at least one said supporting block, said depression being followed by an upright portion which on one side of said plate continues with a cantilevered portion and on the other side of said plate ends with a configuration for engagement with the cantilevered portion of an adjacent plate.

10. A roofing according to claim 9, wherein said cantilevered portion is provided with two lateral reinforcement ridges, whereas on the other side its upright portion ends with a ridge that can engage a corresponding longitudinal ridge of said cantilevered portion of one of said plates, which are in an adjacent position.

11. A roofing according to claim 9, wherein said cantilevered portion ends with a descending wall that has an end wing, whereas on the other side, at a level that is equal to said end wing, the respective upright portion bends substantially in a cantilevered manner to delimit an engagement groove for the end wing of those of said plates, which are followed by a fold shaped like a relatively deep drainage channel.

12. Roofing according to claim 11, wherein said fold shaped like a drainage channel comprises two lateral walls and an inclined bottom wall which is meant to rest and mate on the cradles of the supporting blocks.

* * * * *